US006781298B2

(12) United States Patent
Kim et al.

(10) Patent No.: US 6,781,298 B2
(45) Date of Patent: Aug. 24, 2004

(54) CATHODE RAY TUBE

(75) Inventors: Sung-Hun Kim, Busan (KR); Kyung-Jin Zheong, Gumi (KR); In-Hyuk Hwang, Chilgok (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/153,924

(22) Filed: May 24, 2002

(65) Prior Publication Data

US 2003/0146684 A1 Aug. 7, 2003

(30) Foreign Application Priority Data

Feb. 6, 2002 (KR) ..... 2002/6865

(51) Int. Cl.[7] ..... H01J 29/80; H01J 9/236
(52) U.S. Cl. ..... 313/402; 313/407; 445/30
(58) Field of Search ..... 313/402, 407; 445/30

(56) References Cited

U.S. PATENT DOCUMENTS 5,382,871 A 1/1995 Funahashi et al. ..... 313/402

*Primary Examiner*—Nimeshkumar D. Patel
*Assistant Examiner*—Sharlene Leurig
(74) *Attorney, Agent, or Firm*—Fleshner & Kim, LLP

(57) ABSTRACT

A Cathode Ray Tube (hereinafter, CRT), includes a mask assembly which is composed of a main frame for supporting the shadow mask and a sub frame for supporting the main frame. When the minimum distance between the flat surface extended from the upper surface of the main frame and the flat surface extended from the lower surface of the sub frame is Lb, the height of the sub frame is Ls and the minimum distance between the flat surface extended from the upper surface of the main frame and the flat surface extended from the lower surface of the sub frame, in case the mask is attached to the mask assembly, is La, the following equation, $0.40 \leqq Ls/Lb \leqq 0.55$ or $0.45 \leqq (Ls-Lm)/Lb \leqq 0.59$ is satisfied and after compression, the following equation, $0.08 \leqq (La-Lb)/(Lb-Lm) \leqq 0.17$ is satisfied. Therefore, the creep phenomenon, causing tension degradation and wrinkles at the corner portion of the shadow mask after the heat processing, can be prevented and the howling phenomenon, which can cause serious degradation of quality of screens by vibration of the CRT, can be prevented, considering the instrumental formality with a panel at the same time.

12 Claims, 3 Drawing Sheets

CATHODE RAY TUBE

BACKGROUND OF THE INVENTION

1. Field of the Invention

The present invention relates to a Cathode Ray Tube (hereinafter, CRT) and particularly, to a frame of a CRT, capable of preventing tension lowering and creep phenomena caused by heat processing and howling phenomenon of the cathode ray tube.

2. Description of the Background Art

Generally, a flat screen color CRT, as shown in FIG. 1, is composed of a front glass which is called as a panel 10 and a rear glass which is called as a funnel 20 and they are combined to each other, being enclosed with a high-degree vacuum.

Inside the CRT, a fluorescent layer 40 which functions as a predetermined luminescent material is formed on an inner surface of the panel 10. An electron gun 130 for scanning an electron beam for emitting the fluorescent surface 40. A shadow mask 70 for sorting colors so that the electron beam 60 generated in the electron gun 130 can be landed to a predetermined portion of the fluorescent layer 40. A main frame 30 and sub frame 35 fix and support the shadow mask 70 and a spring 80 combines the assembly of the above frames into the panel 10. An inner shield 90 which is combined with a side surface of the main frame 30 in a spanned shape from the side of the panel 10 to the side of the funnel 20, is positioned on one side surface of the main frame 30, so that the CRT is rarely influenced by a terrestrial magnetism, in operating the CRT.

Also, the flat screen CRT is provided with a reinforcing band 110 installed in the outer circumferential portion of the panel 10 and funnel 20, and accordingly, the flat screen CRT is constructed to have a sufficient resistance against air pressure and exterior impact.

On the other hand, the operation of the CRT shown in FIG. 1 will be described as follows.

First, the electron beam 6 is landed to the fluorescent layer 40 formed on the inner surface of the panel 10 in the electron beam landed to a neck portion of the funnel 20 by positive voltage applied to the CRT. At this time, the electron beam 60 is deflected to the upper and lower directions and left and right directions by the deflection yoke 50 before it reaches the fluorescent layer 40, thus to form a screen.

In addition, a magnet 100 having 2, 4 and 6 poles, for correcting the circle of the process so that the electron beam 60 can exactly land to a predetermined fluorescent material prevents degradation of color purity.

Since such CRT is composed under the condition of high-degree vacuum, a crack can be easily occurred by exterior impact. To prevent the crack, the flat screen CRT is provided with a reinforcing band formed on the circumferential surface of the skirt portion of the funnel 20, and accordingly, the flat screen CRT is constructed to have a sufficient impact resistance by dispersing stress formed in the CRT under the condition of a high-degree vacuum.

In a tension type CRT structure as in FIG. 1, to apply a tension to the shadow mask 70, a frame which supports the shadow mask 70 is compressed, a shadow mask is welded on the compressed frame and the compression added to the frame is stopped so that the tension is applied to the shadow mask 70.

FIG. 2 is a view showing the status that the frame for supporting the shadow mask is combined with the panel.

As shown in FIG. 2, a shadow mask 70 to which a tension is applied, is welded to the end of the main frame 30 and the frame 30 which applies a tension to the shadow mask 70 is combined with the panel 10, connected with a spring 80 and a stud pin 120 inside the panel 10.

Hereinafter, the composition that the shadow mask 70 is combined with the frame 30 will be described in detail.

Conventionally, a frame before being welded is compressed with a predetermined load and welded with the shadow mask 70. Then, a preferred curvature is embodied in the shadow mask by removing a compression load added to the frame and a tension is applied to the upper and lower directions (direction of the short-side line) at the same time. Accordingly, the natural frequency of the shadow mask is increased to prevent the howling phenomenon that a screen vibrates.

However, as the length of the screen is enlarged, the length of the short-side line (vertical direction) is increased and accordingly, the length of the short-side line (vertical direction) of the shadow mask capable of vibrating is lengthened.

Generally, since a natural frequency of a substance is inversely proportional to the length, as the length of the short-side line (vertical direction) of the shadow mask, the natural frequency of the shadow mask attached to the frame decreases.

Therefore, in the combination between the frame and shadow mask 70, the vibration which can be occurred in the shadow mask 70 must be considered due to an additional vibration which can be occurred by the exterior circumstance or in operating the frame and shadow mask 70.

Also, the tension applied to the upper and lower directions of the shadow mask 70 is related to the thickness of the shadow mask 70, heights of the main frame 30 and sub frame 35, curvature to the Z direction of the sub frame 35 and the like and the tension is also related to the ratio between the height of the whole frame and the height of the sub frame, compression load and material characteristic of the frame.

Hereinafter, among the above factors, relationship between the height of the sub frame 35 and the height of the whole frame, and the corresponding problems which is accompanied with the relationship will be described in detail.

First, in case the height of the sub frame 35 is composed smaller than that of the whole frame, that is, in case the curvature of the sub frame 35 is composed large, the suame 35 is composed large, the suth a larger compression load than in case the curvature is gentle, to apply a predetermined tension to the shadow mask 70.

However, since the capacity of the compression motor must be increased to add a larger compression load, the cost is increased.

In addition, the tension applied to the shadow mask 70 is determined according to the degree of the compression of the sub frame 35. The compression amount of the sub frame 35 can be known with the deflection length in the Z direction, which affects the tension applied to the shadow mask 70 as shown in FIG. 3B.

Also, in case the height of the sub frame 35 is composed smaller than that of the whole frame, the sub frame 35 must have a sufficient yield strength that it can stand the deflection force, since a larger stress is applied to the sub frame 35 to deflect the whole frame to the Z direction in FIG. 3*b* with the height as before.

However, since there is a limit with just the yield strength that the material itself has to have a sufficient yield strength, the material characteristic must be improved through the processing method such as additional heat processing of the frame member and the like and accordingly, the cost of the frame member itself is increased.

On the other hand, in case the height of the sub frame 35 is composed larger than that of the whole frame, that is, in case the curvature of the sub frame 35 is composed smaller, a preferred tension can be applied to the shadow mask 70 with a smaller compression load. Namely, as the curvature of the sub frame 35 is smaller, the sub frame can be compressed more easily.

However, in the composition of the sub frame having a larger height than the whole frame, the exterior portion of the sub frame 35, a round portion where the curvature is formed and a part can be protruded to the lower side of the skirt portion 11 of the panel 10.

In the above case, the panel 10 and the frames 30 and 35 must be moved under the condition that they are combined to each other in the manufacturing process of the CRT. In case the sub frame is protruded to the lower side of the skirt portion 11 of the panel 10, foreign material can be inserted to the shadow mask more in moving the panel and frames and the inflow of the foreign material causes a black point effect that the black dots are shown on a screen under the white condition after the CRT is manufactured, thus to degrade the screen characteristic.

Moreover, it is desirable that the band where the natural frequency of the shadow mask 70 is far from the band where the natural frequency of the frame is embodied since the shadow mask is vibrated by vibration of the speaker which is mounted in the product itself where the CRT is installed due to the resonance occurred between the frame and shadow mask in case the distance between the characteristics of the shadow mask 70 and the whole frames 30 and 35 is shortened.

In addition, the vibration of the shadow mask 70 affects the howling phenomenon caused by the vibration of the screen.

To solve the above problem, if the minimum tension amount applied to the shadow mask 70 is increased, the resonance can be easily avoided by becoming parted from the natural frequency of the frame. However, as described above, since the sub frame must have a sufficient yield strength to stand deflection in the Z direction in FIG. 3B, the cost is increased, according to the material characteristic.

Also, in the process of manufacturing the CRT, it includes a frit processing for attaching the funnel 20 to the rear surface of the panel 10 and heat processing for applying vacuum into the tube performed at 350 to 480° C.

When the high temperature heat processing is performed under the condition that the tension is excessively applied to the corner portion of the shadow mask 70, the creep phenomenon which is not occurred at room temperature is occurred, thus to generate a wrinkle at the corner portion of the shadow mask 70.

Also, if the tension applied to the corner portion of the shadow mask exceeds a predetermined value, a wave wrinkle generated by buckling of the shaft of the sub frame 35. If the plastic deflection of the wrinkle is processed, the wave wrinkle of the shadow mask is remained.

To solve the above problem, the condition that the wrinkle is not generated has been obtained by experiments utilizing the method for adjusting the compression amount by changing the curvature of a clamping plate for clamping the shadow mask 70 or applying compression to the frame with the clamp plate.

However, in the method for compressing the frame, there was a problem that a sufficient amount of tension can not be applied to the both welding end portions of the shadow mask 70 and the main frame 30 and the wrinkle is occurred again because of the actual size of the components or subtle irregular composition of the device.

In addition, recently, as the screen of the CRT becomes flatter, the shape of the shadow mask 70 also becomes a flat shape. Accordingly, as the amount of the tension generated at the corner portion among the welding portions of the shadow mask 70 and frame 30 decreases, partial wrinkle is increasingly generated.

In case the partial wrinkle is occurred at the shadow mask 70, the fluorescent material can not be exposed with a uniform pitch width and the quality of the image is degraded.

Also, if the wrinkle is generated at the attached both end portions of the shadow mask 70 and frame 30, on the contrary, a sufficient amount of tension can not be applied to the corner portion of the shadow mask 70. Accordingly, the shadow mask 70 is vibrated at a lower frequency band and the vibration generated once can not easily attenuated.

Therefore, because of the above problem, the relative positions corresponding to the position of the fluorescent surface 40 inside the shadow mask 70 and panel 10 is changed and there can occur problems such as color impurity of the displayed image and the like.

SUMMARY OF THE INVENTION

Therefore, an object of the present invention is to provide a Cathode Ray Tube, capable of preventing the creep phenomenon which causes lowering of the tension after the heat processing and wrinkle to the corner portion of the shadow mask and preventing vibration of the shadow mask of the CRT considering instrumental formality with the panel, by setting an extent of the deflection length before compressing and after compressing of the frame, for applying an appropriate distribution of the tension to the shadow mask.

To achieve these and other advantages and in accordance with the purpose of the present invention, as embodied and broadly described herein, there is provided a CRT, including a panel in which a fluorescent surface is installed; a funnel which is fused and attached to the rear side of the panel using frit glass; a shadow mask having an electron beam through hole combined with the inner side surface of the panel to sort the color of the electron beam; and a mask assembly which is composed of a main frame for supporting the shadow mask and a sub frame for supporting the main frame. In addition, the following equation $0.40 \leqq Ls/Lb \leqq 0.55$ is satisfied when the minimum distance between the flat surface extended from the upper surface of the main frame and the flat surface extended from the lower surface of the sub frame in case a mask is removed from the mask assembly is Lb and the height of the sub frame is Ls.

To achieve these and other advantages and in accordance with the purpose of the present invention, as embodied and broadly described herein, there is provided a CRT, including a panel in which a fluorescent surface is installed; a funnel which is fused and attached to the rear side of the panel using frit glass; a shadow mask having an electron beam through hole combined with the inner side surface of the panel to sort the color of the electron beam; and a mask assembly which is composed of a main frame for supporting the shadow mask and a sub frame for supporting the main frame. In addition, the following equation $0.45 \leqq (Ls-Lm)/Lb \leqq 0.59$ is satisfied when the minimum distance between the flat surface extended from the upper surface of the main frame and the flat surface extended from the lower surface of the sub frame in case a mask is removed from the mask assembly is Lb and the height of the main frame is Lm.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
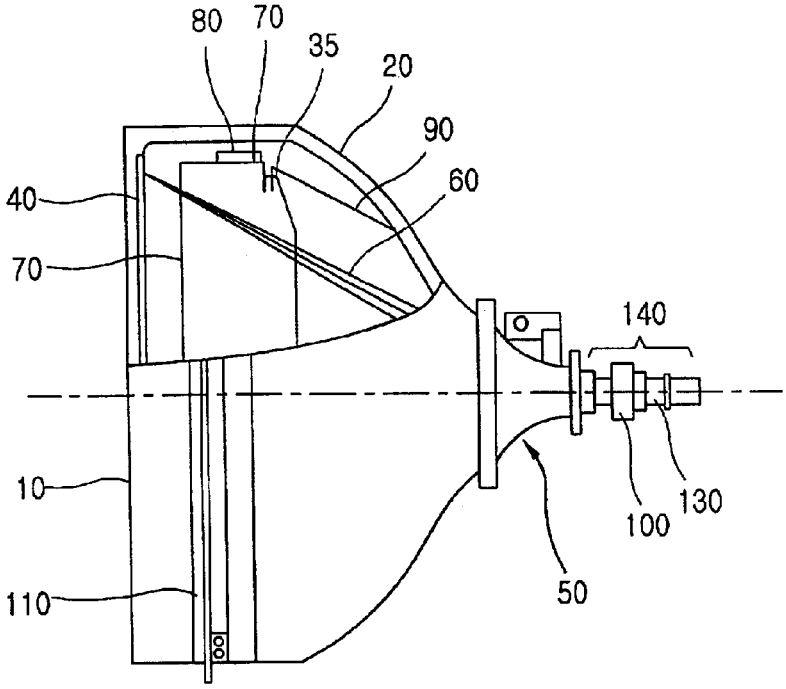
FIG. 1 CONVENTIONAL ART
FIG. 1 a cross-sectional view showing a conventional Cathode Ray Tube (CRT)
Figure 2:
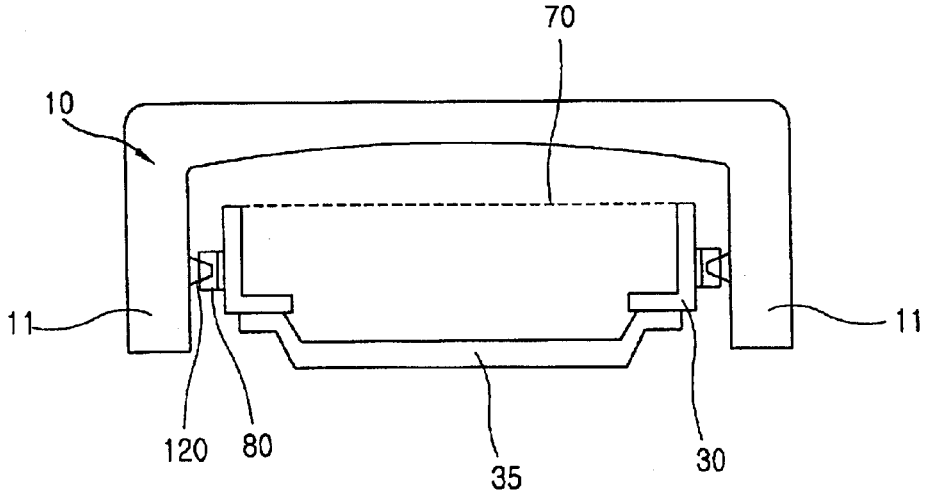
FIG. 2 CONVENTIONAL ART
FIG. 2 is a view showing the status that the frame for supporting the shadow mask is combined with the panel.

Reference will now be made in detail to the preferred embodiments of the present invention, examples of which are illustrated in the accompanying drawings.

Components identical with the conventional components are represented by the same reference numeral and the description of the composition was omitted.

The present invention relates to a CRT, capable of increasing the compression amount without an additional heat processing for improving the intensity of the frame material by setting the extent of the deflection length before and after the shadow mask is mounted in the mask assembly, using elasticity of the material of the frame itself for applying a tension to the shadow mask, thus to increase the tension amount applied to the shadow mask.

Figure 3A:
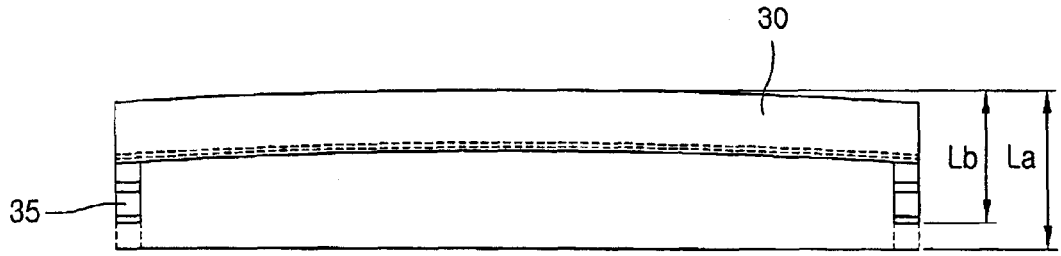
FIG. 3A is a front view showing the frame where the reference numeral defined to describe the present invention is disclosed.
Figure 3B:
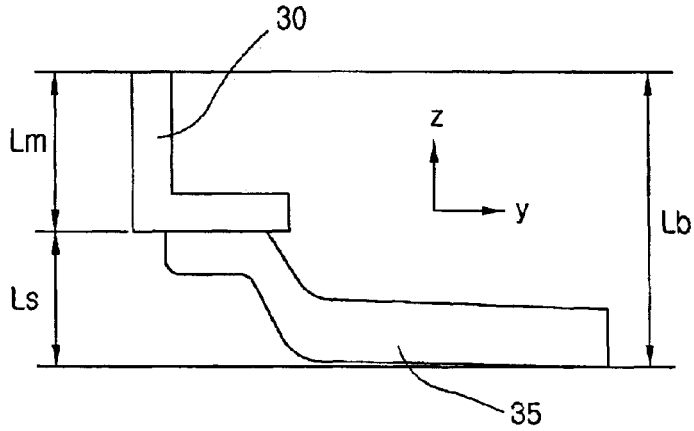
FIG. 3B is a side view showing the frame where the reference numeral defined to describe the present invention is disclosed.
Figure 3C:
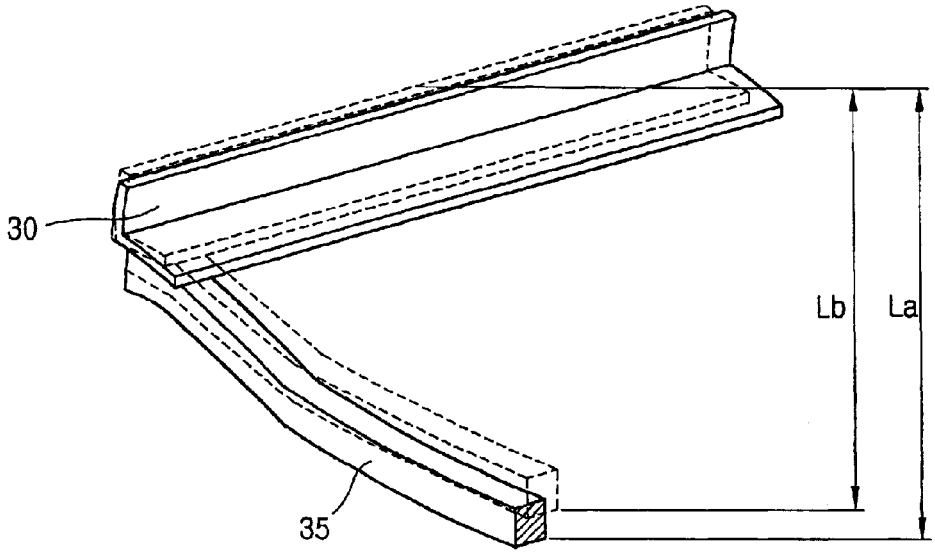
FIG. 3C is a perspective view showing the frame where the reference numeral defined to describe the present invention is disclosed.

In accordance with FIGS. 3A, 3B and 3C of the present invention, when the minimum distance between the flat surface extended from the upper surface of the main frame 30 and the flat surface extended from the lower surface of the sub frame 35 before a shadow mask 70 is mounted in the mask assembly is Lb and the height of the sub frame is Ls, the following equation is satisfied.

$$0.40 \leqq Ls/Lb \leqq 0.55 \quad (1)$$

Also, when the minimum distance between the flat surface extended from the upper surface of the main frame 30 and the flat surface extended from the lower surface of the sub frame 35 after the shadow mask 70 is mounted in the mask assembly is Lb and the height of the main frame is Lm, the following equation is satisfied.

$$0.45 \leqq (Ls-Lm)/Lb \leqq 0.59 \quad (2)$$

Hereinafter, the process for applying the tension to the shadow mask 70 will be described.

First, the sub frame 35 having a predetermined curvature to apply the tension to the shadow mask 70 is mounted in a compression device to compress under a safe condition and then initial compression is performed after centering the mounted frame.

After the initial compression, when the frame is compressed so that the preferred tension is applied to the shadow mask 70, that is, before the shadow mask 70 is mounted (welded) in the mask assembly, the frame must satisfy the extent value of the above equation 1 or 2.

After the initial compression, the shadow mask is loaded and the shadow mask and frame are welded to have a predetermined welding pitch, under the condition that the compressed frame is compressed satisfying the extent value of the equation 1 or 2.

At this time, the welding pitch and the interval must have a sufficient welding strength to maintain the welded condition between the shadow mask and the frame even after unloading the compression of the frame.

Then, the compression of the frame is canceled and accordingly, a preferred tension can be applied to the shadow mask 70 by the restoring force of the frame.

After the frame satisfying the value in Equation 1 or 2 is compressed, that is, when the shadow mask 70 is mounted in the mask assembly, the following equation is satisfied.

$$0.08 \leqq (La-Lb)/(Lb-Lm) \leqq 0.17 \quad (3)$$

In FIG. 3C, the La is a minimum distance between the flat surface extended from the upper surface of the main frame 30 and the flat surface extended from the lower surface of the sub frame 35, in case the shadow mask 70 is attached to the mask assembly, that is, in case the whole frames 30 and 35 are compressed. In addition, the Lb is the minimum distance between the flat surface extended from the upper surface of the main frame 30 and the flat surface extended from the lower surface of the sub frame 35, before the whole frames 30 and 35 are compressed.

Namely, according to the minimum distance Lb between the flat surface extended from the upper surface of the main frame 30 and the flat surface extended from the lower surface of the sub frame 35, in case the shadow mask 70 is removed from the mask assembly and the minimum distance La between the flat surface extended from the upper surface of the main frame 30 and the flat surface extended from the lower surface of the sub frame 35, in case the shadow mask 70 is attached to the mask assembly, the tension applied to the shadow mask is determined.

In accordance with the present invention, if the equations 1 and 2 are satisfied, before the whole frames 30 and 35 are compressed, and the equation 3 is satisfied, after the whole frames 30 and 35 are compressed, the resonance frequency band of the shadow mask 70 is located in a completely different range from that of the whole frames 30 and 35.

Also, a sufficient tension can be applied with an additional processing and the creep phenomenon which generates wrinkles in the corner portion of the shadow mask 70 can be prevented.

Figure 4:
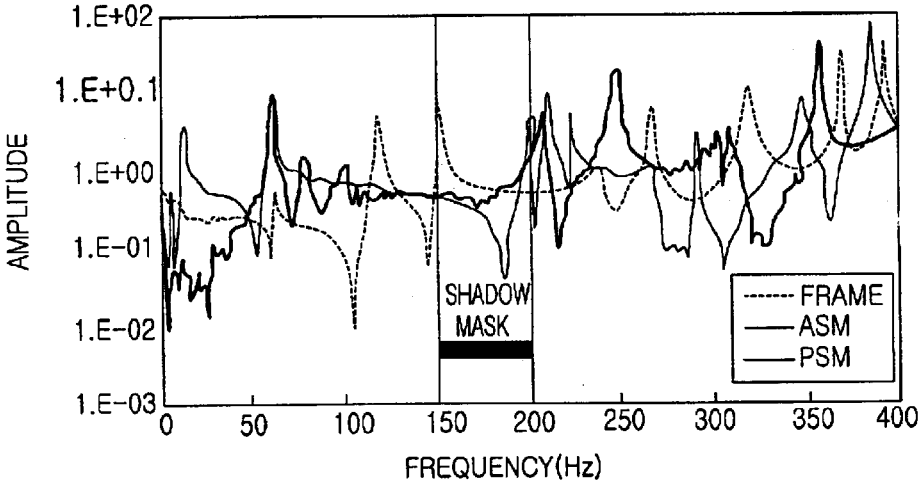
FIG. 4 is a graph showing degradation of the band of the frame resonance frequency and the creep characteristic.

FIG. 4 is a graph showing the resonance frequency band of the whole frames 30 and 35 and frequency band of the shadow mask 70.

In FIG. 4, the resonance frequency band of the whole frames 30 and 35 is within 90 Hz and the frequency band of the shadow mask 70 is 150 Hz to 210 Hz. Accordingly, it can be known that the frequency band of the shadow mask 70 is located in a completely different range from the resonance frequency of the frame.

Figure 5:
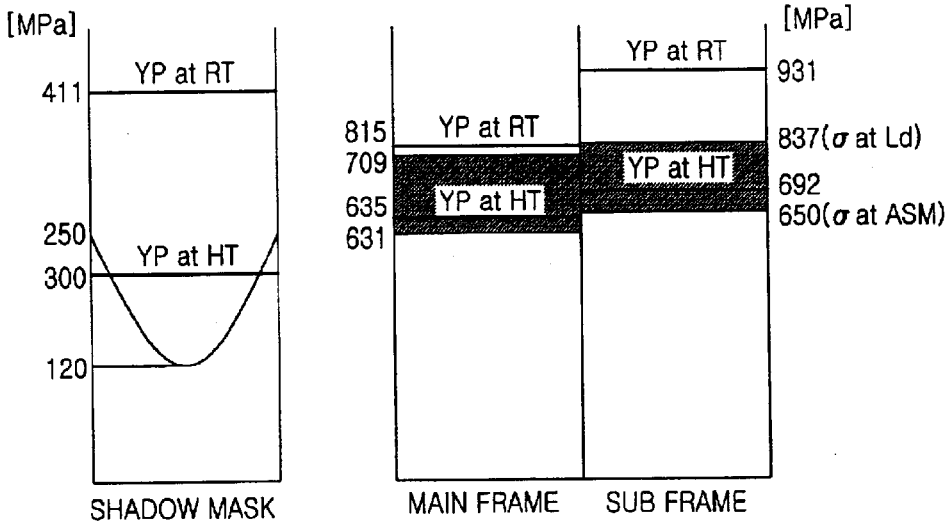
FIG. 5 is a schematic view showing the value of material strength of the mask assembly in accordance with the present invention.

FIG. 5 is a schematic view showing the value of material strength of the shadow mask in accordance with the present invention.

As shown in FIG. 5, the yield strength of the shadow mask 70 in accordance with the present invention is respectively 411 Mpa and 300 Mpa and the stress applied to the shadow mask 70 is 120 to 150 Mpa. All of the values are within the range of the yield strength of the shadow mask 70.

Also, the yield strengths of the main frame 30 at room temperature and high temperature are respectively 815 Mpa and 635 Mpa and the stress applied to the main frame before and after compression, that is when the mask is removed from the mask assembly or attached to the mask assembly is 631 to 709 Mpa. All of the values are within the range of the yield strength of the main frame at room temperature and high temperature.

Also, the yield strengths of the sub frame at room temperature and high temperature are respectively 931 Mpa and 692 Mpa and the stress, before and after compression, that is when the mask is removed from the mask assembly or attached to the mask assembly, is 650 to 837 Mpa. All of the values are within the range of the yield strength of the main frame at room temperature.

Therefore, as described above, an additional heat processing for raising the strength of the main frame or sub frame is not necessary. A preferred designed value can be obtained just with the current level of material characteristic.

Therefore, the creep phenomenon, which generates wrinkles at the corner portion of the shadow mask 70 caused by the heat processing in the manufacturing process, can be prevented.

Also, if the frames 30 and 35 which are attached to the shadow mask 70 is designed in the extent with reference to the present invention, the frames 30 and 35 are completely inserted into the inner side of the panel 10. Accordingly, inflow of foreign materials in moving the frame can be prevented and black point effects occurred on the screen of the CRT can be prevented.

The following Table 1 is to compare the results of the experiment of the frame in accordance with the present invention and the frame in accordance with the conventional art.

TABLE 1

| | Ls/Lb | (Lb-Lm)/Lb | (La-Lb)/(Lb-Lm) | Mask Frequency | Creep Phenomenon Yes/No | Frame Frequency | Formality of panel |
|---|---|---|---|---|---|---|---|
| Present invention 1 | 0.55 | 0.59 | 0.08 | 166/210 | No | 80 | in |
| Present invention 2 | 0.47 | 0.57 | 0.11 | 183/225 | No | 75 | in |
| Present invention 3 | 0.44 | 0.50 | 0.17 | 152/235 | No | 110 | in |
| Present invention 4 | 0.40 | 0.55 | 0.11 | 163/215 | No | 85 | in |
| Present invention 5 | 0.49 | 0.45 | 0.17 | 164/220 | No | 105 | in |
| Conventional art 1 | 0.56 | 0.60 | 0.12 | 130/260 | Yes | 100 | out |
| Conventional art 2 | 0.57 | 0.68 | 0.07 | 165/280 | Yes | 115 | out |
| Conventional art 3 | 0.58 | 0.65 | 0.05 | 130/260 | Yes | 105 | out |

As shown in Table 1, in case Ls/Lb of the frame in accordance with the present invention is between 0.4 and 0.55, the natural frequency of the shadow mask 70 is 152 to 183 Hz and the natural frequency of the frames 30 and 35 is 80 to 110 Hz.

As the natural frequency of the shadow mask 70 and natural frequency of the frames 30 and 35 are more apart, vibration caused by the exterior vibration can be prevented better. In Table 1, the frequencies of the frame and shadow mask in accordance with the conventional art have differences of 30, 50 and 25 Hz and on the other hand, the frequencies of the frame and shadow mask in accordance with the present invention have differences of 86, 108, 62, 78 and 59 Hz, which are larger than the above value of the conventional art.

Therefore, in case the frequencies of the frame and shadow mask in accordance with the present invention are applied, since the present invention has a band width of 59 to 108 Hz, having 200% more effect than the value of 25 to 50 Hz of the conventional art. Accordingly, the selective locating of the resonance frequency of the frame can be achieved better and howling phenomenon can be prevented better.

Also, in case (Lb−Lm)/Lb of the frames 30 and 35 in accordance with the present invention is within the extent of 0.45 to 0.59, the frequency of the shadow mask 70 is 210 to 235 Hz to have a high natural frequency. Accordingly, when the tension applied to the corner portion of the shadow mask 70 exceeds a predetermined value, generation of wave wrinkles caused by buckling, can be prevented.

Also, since the sub frame 35 attached to the shadow mask in accordance with the present invention is completely inserted to the inside of the panel 10, inflow of foreign materials to the shadow mask can be prevented in transporting the shadow mask and panel which are combined to each other.

Therefore, in accordance with the present invention, by setting an extent of the deflection length before compressing and after compressing of the frame, the extent of the natural frequency of the shadow mask is located in a different region from that of the resonance frequency band of the frame, thus to prevent the howling phenomenon by vibration of the exterior speaker.

Also, the cost is low since the heat processing is not performed and the creep phenomenon, causing wrinkles in the corner portion of the shadow mask by the heat processing, can be prevented.

In addition, the serious problem that the quality of the image of the CRT is degraded can be prevented since the fluorescent material is not exposed to light at a uniform pitch width, in the process of coating fluorescent material on the inner surface of the panel, due to the wrinkle effects generated at the corner portion of the shadow mask.

Also, the serious black point effect for the screen characteristic can be prevented by inserting the frame into the skirt portion of the panel.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A Cathode Ray Tube (CRT), comprising:

a panel on which a fluorescent surface is installed;

a funnel which is fused to a rear side of the panel using frit glass;

a shadow mask having an electron beam through hole provided adjacent to an inner side surface of the panel to sort the color of the electron beam; and a mask assembly configured to support the shadow mask and comprising a main frame for supporting the shadow mask and a sub frame for supporting the main frame, wherein the CRT satisfies the following equation:

$$0.40 \leqq Ls/Lb \leqq 0.55$$

where Lb is a minimum distance between a flat surface extended from an upper surface of the main frame and a flat surface extended from a lower surface of the sub frame before the shadow mask is attached to the mask assembly and Ls is a height of the sub frame.

2. The CRT of claim 1, wherein the CRT satisfies the following equation:

$$0.08 \leqq (La-Lb)/(Lb-Lm) \leqq 0.17$$

where Lm is a height of the main frame and La is a minimum distance between the flat surface extended from the upper surface of the main frame and the flat surface extended from the lower surface of the sub frame after the shadow mask is attached to the mask assembly.

3. A Cathode Ray Tube (CRT), comprising:

a panel in which a fluorescent surface is installed;

a funnel which is fused to a rear side of the panel using flit glass;

a shadow mask having an electron beam through hole provided adjacent to an inner side surface of the panel to sort the color of the electron beam; and a mask assembly comprising a main frame for supporting the shadow mask and a sub frame for supporting the main frame, wherein the CRT satisfies the following equation:

$$0.45 \leqq (Ls-Lm)/Lb \leqq 0.59$$

where Lb is a minimum distance between a flat surface extended from an upper surface of the main frame and a flat surface extended from a lower surface of the sub frame before the shadow mask is attached to the mask assembly, La is a height of the sub frame, and Lm is a height of the main frame.

4. The CRT of claim 2, wherein the CRT satisfies the following equation:

$$0.08 \leqq (La-Lb)/(Lb-Lm) \leqq 0.17$$

where La is a minimum distance between the flat surface extended from the upper surface of the main frame and the flat surface extended from the lower surface of the sub frame after the shadow mask is attached to the mask assembly.

5. A Cathode Ray Tube (CRT), comprising:

panel having a fluorescent surface;

a funnel attached to a rear side of the panel;

a shadow mask positioned adjacent to the panel; and a mask frame assembly comprising a main frame configured to support the shadow mask and a sub frame configured to support the main frame, wherein the CRT satisfies the following equation:

$$0.40 \leqq Ls/Lb \leqq 0.55$$

where Lb is a minimum distance between a flat surface extended from an upper surface of the main frame and a flat surface extended from a lower surface of the sub frame before the shadow mask is attached to the mask frame assembly and Ls is a height of the sub frame.

6. The CRT of claim 5, wherein the CRT satisfies the following equation:

$$0.08 \leqq (La-Lb)/(Lb-Lm) \leqq 0.17$$

where Lm is a height of the main frame and La is a minimum distance between the flat surface extended from the upper surface of the main frame and the flat surface extended from the lower surface of the sub frame after the shadow mask is attached to the mask frame assembly.

7. A Cathode Ray Tube (CRT), comprising:

a panel having a fluorescent surface installed;

a funnel attached to a rear side of the panel;

a shadow mask positioned adjacent the panel; and a mask frame assembly comprising a main frame configured to support the shadow mask and a sub frame configured to support the main frame, wherein the CRT satisfies the following equation:

$$0.45 \leqq (Ls-Lm)/Lb \leqq 0.59$$

where Lb is a minimum distance between a flat surface extended from an upper surface of the main frame and a flat surface extended from a lower surface of the sub frame before the shadow mask is attached to the mask frame assembly, Ls is a height of the sub frame, and Lm is a height of the main frame.

8. The CRT of claim 7, wherein the CRT satisfies the following equation:

$$0.08 \leqq (La-Lb)/(Lb-Lm) \leqq 0.17$$

where La is a minimum distance between the flat surface extended from the upper surface of the main frame and the flat surface extended from the lower surface of the sub frame after the shadow mask is attached to the mask frame assembly.

9. A shadow mask assembly for a Cathode Ray Tube (CRT), comprising:

a shadow mask; and a mask frame assembly comprising a main frame configured to support the shadow mask and a sub frame configured to support the main frame, wherein the shadow mask assembly satisfies the following equation:

$$0.40 \leqq Ls/Lb \leqq 0.55$$

where Lb is a minimum distance between a flat surface extended from an upper surface of the main frame and a flat surface extended from a lower surface of the sub frame before the shadow mask is attached to the mask frame assembly and Ls is a height of the sub frame.

10. The shadow mask assembly of claim 9, wherein the shadow mask assembly satisfies the following equation:

$$0.08 \leqq (La-Lb)/(Lb-Lm) \leqq 0.17$$

where Lm is a height of the main frame and La is a minimum distance between the flat surface extended from the upper surface of the main frame and the flat surface extended from the lower surface of the sub frame after the shadow mask is attached to the mask frame assembly.

11. A shadow mask assembly for a Cathode Ray Tube (CRT), comprising:

a shadow mask; and a mask frame assembly comprising a main frame configured to support the shadow mask and a sub frame configured to support the main frame, wherein the shadow mask assembly satisfies the following equation:

$$0.45 \leqq (Ls-Lm)/Lb \leqq 0.59$$

where Lb is a minimum distance between a flat surface extended from an upper surface of the main frame and a flat surface extended from a lower surface of the sub frame before the shadow mask is attached to the mask frame assembly, Ls is a height of the sub frame, and Lm is a height of the main frame.

12. The shadow mask assembly of claim 11, wherein the shadow mask assembly satisfies the following equation:

$$0.08 \leqq (La-Lb)/(Lb-Lm) \leqq 0.17$$

where La is a minimum distance between the flat surface extended from the upper surface of the main frame and the flat surface extended from the lower surface of the sub frame after the shadow mask is attached to the mask frame assembly.

* * * * *